US007126134B2

(12) United States Patent
Lean et al.

(10) Patent No.: US 7,126,134 B2
(45) Date of Patent: Oct. 24, 2006

(54) SAMPLE MANIPULATOR

(75) Inventors: Meng H. Lean, Santa Clara, CA (US); Francisco E. Torres, San Jose, CA (US); Huangpin Ben Hsieh, Mountain View, CA (US); Armin R. Völkel, Mountain View, CA (US); Bryan Preas, Palo Alto, CA (US); Scott A. Elrod, LaHonda, CA (US); John S. Fitch, Los Altos, CA (US); Richard H. Bruce, Los Altos, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 68 days.

(21) Appl. No.: 10/921,556

(22) Filed: Aug. 19, 2004

(65) Prior Publication Data

US 2006/0038120 A1 Feb. 23, 2006

(51) Int. Cl.
*G21K 5/10* (2006.01)

(52) U.S. Cl. ..... 250/442.11

(58) Field of Classification Search ..... 250/309, 250/442.11, 309.11; 356/316; 422/63
See application file for complete search history.

(56) References Cited

U.S. PATENT DOCUMENTS

| | | | | |
|---|---|---|---|---|
| 4,896,174 | A | 1/1990 | Stearns | |
| 5,893,015 | A | 4/1999 | Mojarradi et al. | |
| 6,134,412 | A | 10/2000 | Thompson | |
| 6,137,979 | A | 10/2000 | Gartstein et al. | |
| 6,149,789 | A * | 11/2000 | Benecke et al. | 204/547 |
| 6,219,515 | B1 | 4/2001 | Lestrange | |
| 6,246,855 | B1 | 6/2001 | Gartstein et al. | |
| 6,272,296 | B1 | 8/2001 | Gartstein | |
| 6,290,342 | B1 | 9/2001 | Vo et al. | |
| 6,296,752 | B1 * | 10/2001 | McBride et al. | 204/547 |
| 6,351,623 | B1 | 2/2002 | Thayer et al. | |
| 6,499,831 | B1 | 12/2002 | Schmidlin | |
| 6,858,184 | B1 * | 2/2005 | Pelrine et al. | 422/68.1 |
| 2004/0251135 | A1 * | 12/2004 | Lean et al. | 204/456 |
| 2005/0123930 | A1 * | 6/2005 | Lean et al. | 435/6 |

FOREIGN PATENT DOCUMENTS

| | | |
|---|---|---|
| EP | 1538440 | 6/2005 |
| WO | WO 97/34689 | 9/1997 |
| WO | WO 01/05514 | 1/2001 |
| WO | WO 02/076585 | 10/2002 |

OTHER PUBLICATIONS

LabVIEW 7.1, National Instruments, at http://www.ni.com/labview, pp. 1-2, Jun. 25, 2004.
ChemImage, ChemIcon Inc., The Chemical Imaging Company, at http://www.chemimage.com, 6 pages, Jun. 25, 2004.
Moesner et al., "Electrostatic Devices for Particle Microhandling," IEEE Service Center, vol. 35, No. 3, pp. 530-536, 1999.
Kawamoto et al., "Traveling Wave Transport of Particles and Particle Size Classification," Journal of Imaging Science and Technology, vol. 48, No. 5, pp. 404-411, 2004.

* cited by examiner

*Primary Examiner*—Nikita Wells
*Assistant Examiner*—Johnnie L Smith, II
(74) *Attorney, Agent, or Firm*—Fay, Sharpe, Fagan, Minnich & McKee, LLP

(57) ABSTRACT

A sample manipulator that utilizes electrostatic traveling waves to selectively displace one or more samples deposited on its face is disclosed. The sample manipulator enables an operator to perform a wide variety of processes upon the deposited samples. Also disclosed are strategies for separating two or more samples, focusing a sample, and passing a reagent through a sample, all conducted on the face of the sample manipulator.

4 Claims, 6 Drawing Sheets

SAMPLE MANIPULATOR

BACKGROUND

The present exemplary embodiment relates to sampling and assay systems. It finds particular application in conjunction with the analysis of biological samples, and will be described with particular reference thereto. However, it is to be appreciated that the present exemplary embodiment is also amenable to other like applications.

Conventional slides are passive substrates on which samples are fixed and mounted for microscopy. With precision optics and specimen staining or fluorescent tagging, very high speed and high resolution images are achieved, making it possible to observe processes such as localization of cellular components and monitoring their interactions among themselves or with the outside world. Thus, there is a strong need to have active control or to speed up these processes.

On a macro scale, manipulation of cells, bacteria, or viruses are desired as it pertains to interesting applications such as bio-agent detection New development in optical trapping has made tools such as laser tweezers or scissors available for manipulation on a single cell scale. However, there are certain restrictions to the medium to which the laser is applied, and optical trapping is not easily amenable to parallel or larger scale processing. As a consequence, an improved method that allows the operator to have control over the migration of the biomolecules is highly desirable.

Electric fields can be used to move charged molecules without contact, examples being electrophoretic and electroosmotic techniques. Such means are effective in many types of media such as aqueous or organic solutions, air/aerosol, or high-viscosity media including various types of gels. However, traditional means of using electric fields to move biomolecules (such as electrophoresis) rely on mobilizing all particles between two electrodes placed on either side of a sample, which does not allow control over individual molecules or multiple small regions within a sample slide.

The present exemplary embodiment relates to selectively controllable sample slides, methods to fabricate such slides, and methods for their use which enable interactive steering of specimens on slides viewed by biochemical imaging systems.

BRIEF DESCRIPTION

In accordance with one aspect of the present exemplary embodiment, a sample manipulator is provided that is adapted for use in microscopy and imaging systems. The sample manipulator comprises a substrate, a collection of traveling wave electrodes disposed on the substrate, a means for addressing the traveling wave electrodes and applying at least one electrical signal thereto, and a layer of a medium for transport of a sample therein, disposed on the substrate. Upon administering a sample in the medium, the sample can be selectively displaced from a first location to a second location on the substrate by application of a suitable electrical signal to the traveling wave electrodes.

In accordance with another aspect of the exemplary embodiment, a sample manipulator is provided which is adapted for use in microscopy and imaging systems. The sample manipulator comprises a substrate, a collection of electrically conducting busses disposed on the substrate, and a layer of an electrical insulator also disposed on the substrate. The sample manipulator also comprises a collection of traveling wave electrodes disposed on the layer of electrical insulator, and a collection of electrically conductive vias per bus. The vias provide both electrical redundancy and provide the traveling wave electrodes to be biased from both ends by the busses to thereby minimize voltage decreases due to electrode current. Upon depositing one or more samples in a layer of suitable medium on the traveling wave electrodes, the one or more samples can be selectively displaced from a first location to second location on the sample manipulator by application of a suitable voltage waveform to the collection of buses.

In another aspect of the present exemplary embodiment, a system for selectively moving a sample on a viewing surface is provided as follows. The system comprises an electronic controller and a sample manipulator. The controller has at least one output. The controller is capable of generating at least one waveform at the output. The sample manipulator includes a substrate and a collection of traveling wave electrodes disposed on the substrate. The collection of electrodes is in electrical communication with the at least one output of the controller. Upon depositing a sample on the substrate and in proximity to the traveling wave electrodes, the sample can be selectively moved from a first location on the substrate to a second location by application of a suitable waveform to the electrodes.

In another aspect of the exemplary embodiment, a method for separating a first sample from a second sample is provided. The method uses a sample manipulator including a substrate and a collection of traveling wave electrodes disposed on the substrate. The method comprises a step of depositing the first sample on the sample manipulator, and a step of depositing the second sample on the sample manipulator. The method also comprises a step of determining a suitable sweep frequency for a voltage waveform to be applied to the electrodes of the sample manipulator. The method also comprises a step of applying the voltage waveform at the determined sweep frequency to the sample manipulator to thereby generate electrostatic traveling waves across the collection of traveling wave electrodes. As a result of the traveling waves at the determined sweep frequency, the first sample travels at a first velocity across at least the region of the sample manipulator, and the second sample travels at a second velocity across at least the region of the sample manipulator. The second velocity is different than the first velocity, causing the two samples to separate spatially.

In accordance with another aspect of the present exemplary embodiment, a method is provided for focusing a sample by use of a sample manipulator. The sample manipulator comprises a substrate and a collection of traveling wave electrodes disposed on the substrate. The method comprises a step of depositing the sample on the sample manipulator and selecting at least one location on the traveling wave electrodes for generating the traveling waves. The method also comprises a step of applying at least one voltage waveform at the selected at least one location to thereby generate traveling waves at the selected at least one location. Upon the traveling waves being applied to the deposited sample, the sample is focused.

In yet another aspect according to the exemplary embodiment, a method is provided for reacting a suitable collection of two or more reagents. The method uses a sample manipulator comprising a substrate and a collection of traveling wave electrodes disposed on the substrate. The method comprises a step of depositing one or more reagents at a first location on the sample manipulator. The method also comprises a step of depositing one or more additional reagents at a second location on the sample manipulator. The method also comprises a step of determining a suitable frequency for a voltage waveform of traveling waves to be applied to the electrodes of the sample manipulator. And, the method comprises a step of applying the voltage waveform at the determined frequency to the sample manipulator to thereby cause electrostatic traveling waves to move the reagents from the second location to the first location, whereby reagents of interest are brought into contact and in so doing react therewith.

In other aspects of the exemplary embodiment, the abovementioned separating, concentrating, and reacting modes can be used in conjunction, for example in sequence or in parallel, to perform multiple sample manipulations. For example, samples could be separated into different species, and then each species could be locally concentrated. As another example, reagents could be brought together to react and bind to one another, and then the sample could undergo the abovementioned separation mode to separate reacted from unreacted species. In yet another example, a sample may be moved and concentrated at the same time, or concentrated and reacted at the same time, or otherwise manipulated using a combination of available modes. Many other useful combinations will be apparent to those skilled in the art and are included herein.

DETAILED DESCRIPTION

Figure 1:
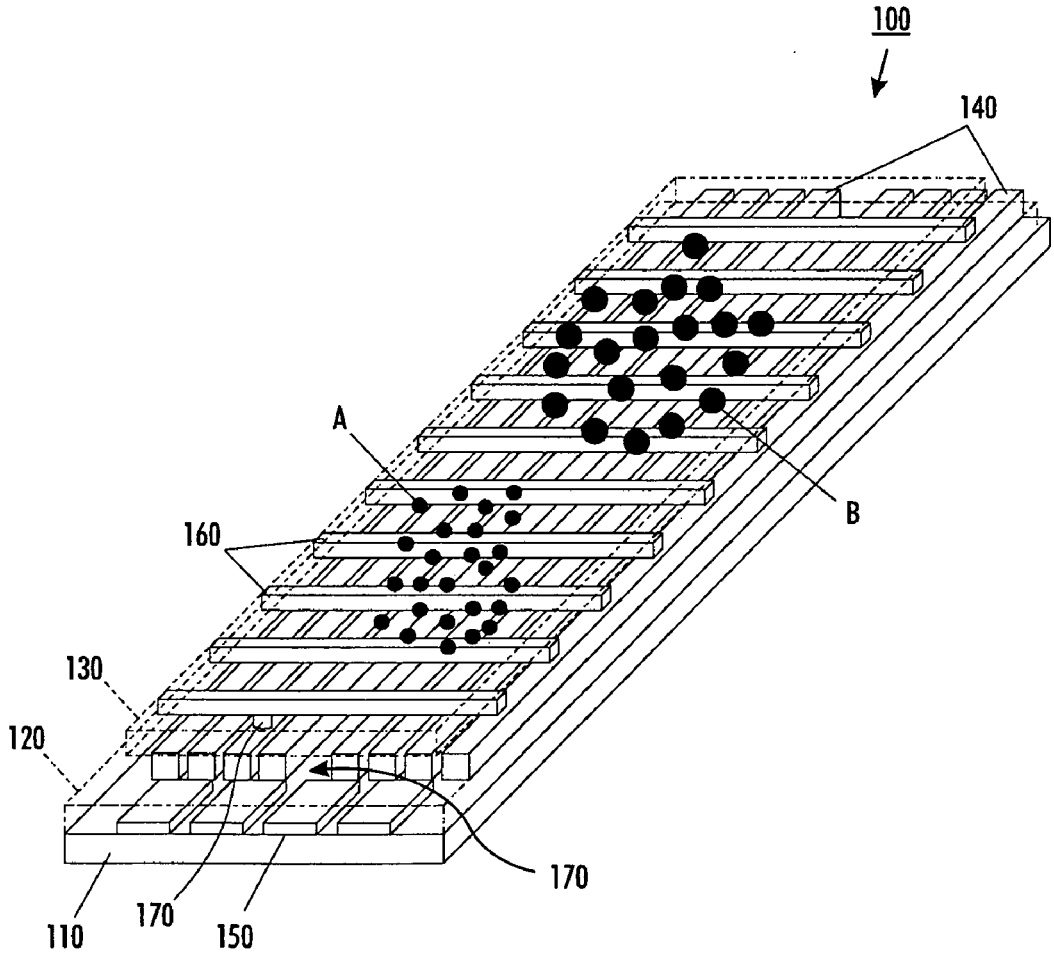
FIG. 1 is an illustration of an exemplary embodiment sample manipulator illustrating two samples in a fluid/gel medium on a three-layer structure.

The exemplary embodiment relates to a sample manipulator, methods to fabricate such a device, and use of such sample manipulators which enable interactive steering of samples, particles, and/or bio-agents such as biochemical imaging agents. The exemplary embodiment sample manipulator as described herein is particularly adapted for use with microscopy and imaging systems, such as in the analysis of biological samples.

The exemplary embodiment sample manipulator can be proactively controlled by a user. When utilized in conjunction with near real-time visualization, for example, a few frames/second of visual feedback, the sample manipulator can provide interactively "steerable" sample manipulation and "joy-stick" control of specimens. These aspects are described in greater detail herein. The sample manipulators described herein utilize electrostatic traveling wave grids which are individually addressable and reconfigurable "on-the-fly" to achieve several programmable functions. Control can be provided in two steps. For example, to move two samples on the exemplary embodiment device to a new target location, that target is selected and then one or more traveling waves are generated in the device to move the two samples to the target. In a first step, the cursor of a joy-stick or other controller is positioned to a target location in the space between two sample traces, and an activation signal is then issued, such as for example by a thumb click. An image is generated on an associated monitor which may include registration cues and allows an algorithm to identify the two adjacent traces as n and n+1. Depending on the mode of use, two preprogrammed traveling wave algorithms, for example, one on each side of the cursor position, with some means of selecting the sweep frequencies may be exercised through a Labview controller for example to the traveling wave grids.

The present exemplary embodiment sample manipulator generally comprises a substrate, a layer of a suitable medium for transport of one or more samples deposited within or on the layer, a collection of traveling wave electrodes disposed on the substrate, and a system or component for addressing the traveling wave electrodes. Each of these aspects is described in greater detail herein. The system or component for addressing the traveling wave electrodes can be in the form of a collection of electrically conductive busses or secondary set of electrodes that provide electrical communication from a voltage or electrical signal source, to the traveling wave electrodes. The system or component can also employ one or more electrically conducting vias to transmit the signals to the traveling wave electrodes. The system or component for addressing the traveling wave electrodes can for example, be in the form of one or more edge connectors disposed along the periphery of the exemplary embodiment sample manipulator. Alternately, one or more small electronic IC chips could be incorporated within the exemplary embodiment sample manipulator to perform the desired addressing. Algorithms or other logic could determine which chip to perform the necessary addressing, and/or the details of the addressing. It is also contemplated to utilize capacitive coupling to address the traveling wave electrodes.

FIG. 1 illustrates a three-dimensional perspective view of an exemplary embodiment sample manipulator structure, which could conform to the existing one inch by three inch slide format used in many applications. The exemplary embodiment structure includes a 3-layered structure on a glass substrate. Although glass is noted, the exemplary embodiment can utilize any suitable substrate material. The bottom layer includes a collection, such as eight (8) for example, of large cross-sectioned aluminum busses serving as transmission and return lines, designed for minimum voltage drops for a four phase drive. The middle layer can include an electrically insulating material such as a 3 μm thick layer of silicon oxinitride (SiON). Alternatively, insulating polymers may also be used for less expensive solutions, for example blade-coated, dip coated, spin coated, web coated, or vapor deposited polymers. Examples include but are not limited to polyimides, polyurethanes, polyethylenes, polypropylenes, polystyrenes, polyacrylates, UV curable polymers, parylene C, parylene N, parylene F, etc. For some applications, low cost processes are desirable. In such cases, using printed circuit board or flex circuit technologies for depositing metallization and insulator materials provides a lower cost alternative for fabrication.

The top layer includes traveling wave electrodes fabricated for example, from platinum on titanium to promote adhesion, and connected to the aluminum busses two layers below through a large number of redundant vias. In addition to redundancy, the large number of vias also shorten the electrical path along the traces. Each trace is also biased at both ends to further halve the return path and therefore reduce voltage drop between trace contacts. The electrical design aims specifically to minimize voltage drop along the traveling wave electrodes, which might otherwise occur due to the electrochemical current needed to sustain transport. Again, it will be appreciated that the exemplary embodiment is in no way limited to the noted materials.

Traveling wave electrodes, their use for powder in air, and manufacture are generally described in U.S. Pat. Nos. 6,351,623; 6,290,342; 6,272,296; 6,246,855; 6,219,515; 6,137,979; 6,134,412; 5,893,015; and 4,896,174, all of which are hereby incorporated by reference.

Specifically, FIG. 1 depicts a sample manipulator 100 comprising a glass substrate 110, a layer of an electrical insulator 120 disposed on the substrate 110, and a layer of a suitable fluid or gel medium 130 disposed on the insulator layer 120. As will be appreciated, the substrate 110 is not limited to glass, but in certain embodiments, is optically transparent or substantially so. Disposed on the substrate 110 are a plurality of electrically conducting busses 140. One or more, for example four (4), contact pads 150, provide electrical access and communication to the busses 140. Disposed on the insulator layer 120 are a plurality of traveling wave electrodes or traces 160. Generally, the traces 160 are spaced apart and parallel with each other as described in greater detail herein. And, a plurality of electrically conductive vias 170 extend through the insulator layer 120 and provide electrical communication between the electrodes 160 and the busses 140. Generally, the vias extend through the thickness, or at least partially so, of the layered assembly. A multi-phase, such as a four (4) phase electrical signal is used in conjunction with the exemplary embodiment systems, assemblies, and grids noted herein. Accordingly, a first electrode is utilized for a first phase Φ1 of the electrical signal. Similarly, a second electrode immediately adjacent to the first is utilized for a second phase Φ2 of the electrical signal. And, a third electrode immediately adjacent to the second electrode is utilized for a third phase Φ3 of the electrical signal. Moreover, a fourth electrode immediately adjacent to the third electrode is utilized for a fourth phase Φ4 of the electrical signal. The action of electrical signals imparted upon the electrodes 160 induces movement of samples, such as samples A and B dispersed in the medium 130. Although in most applications a layer of a suitable medium, such as medium 130, will be used through which the one or more samples are transported, the exemplary embodiment sample manipulator can be used to transport samples deposited on the device in a medium of air, aerosol or other gas as well. However, since most biomolecules or other species exhibit a charge in an aqueous solution, or upon adjustment of the pH of the solution, it is contemplated that the exemplary embodiment sample manipulator will typically utilize a medium such as medium layer 130.

As noted, the substrate of the exemplary embodiment sample manipulator can be optically transparent. However, in certain applications, the substrate can be reflective or substantially so. The choice of which substrate to use depends upon the application and mode of use of the exemplary embodiment sample manipulator. For example, either or both reflection or transmission illumination modes could be used. Reflection modes would have the light source on the same side as the sample. Transmission mode would have the light source originating from the other side of the sample. The choice of the preferred illumination depends on the sample being either more reflective or transmissive. For application in which the substrate is optically transparent or substantially so, the traveling wave electrodes and other components of the sample manipulator such as for example one or more busses, are generally also optically transparent or substantially so. In certain versions, it may be desired to utilize optically transparent traveling wave electrodes or other components in conjunction with a reflective substrate. In addition, the exemplary embodiment sample manipulator also includes the use of optically reflective traveling wave electrodes and/or other components. In operation and inducement of the traveling waves to the collection of traveling wave electrodes, one or more desired waveforms are applied to successive sets of traveling wave electrodes to attain a desired temporal waveform at each traveling wave electrode across the sample manipulator or region thereof.

Figure 2:
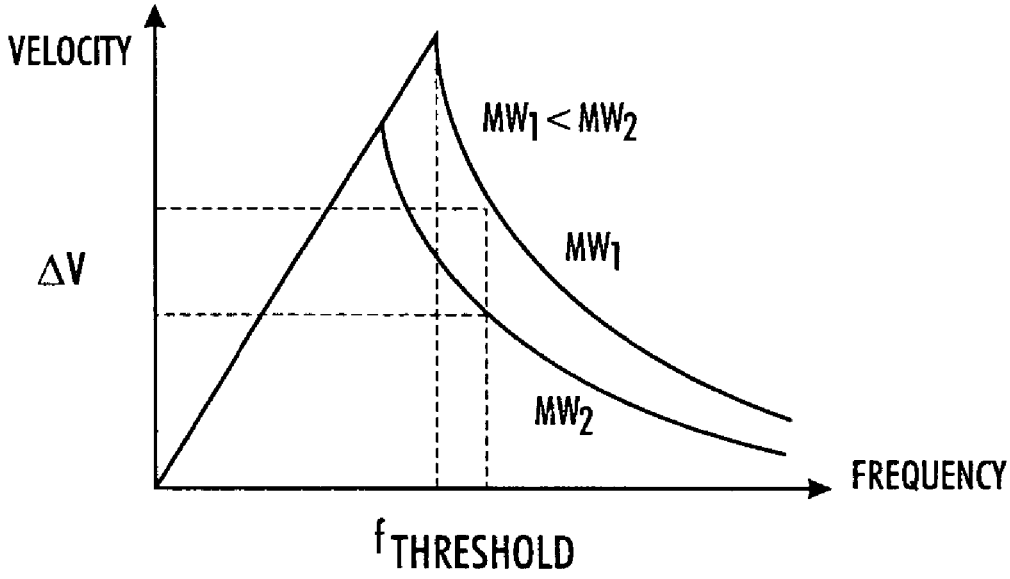
FIG. 2 is a graph of frequency response curves for two samples with differing molecular weights.

More specifically, in traveling wave technology, an electrostatic wave is produced by applying time-varying voltages to a series of successive electrodes such as to electrodes 160 in FIG. 1. The voltages are phased so that an electrostatic wave progresses in time in a direction orthogonal to the electrode array. Proteins or other biological molecules and inorganic material may be moved by traveling waves provided they have a charge. For a species with a given mobility μ, there are two modes of transport within a traveling wave device: a synchronous regime up to a threshold frequency below which the species will move in-step with the traveling wave field; and an asynchronous regime beyond the threshold frequency where the species will not be able to keep pace with the traveling wave. This threshold frequency is given by:

$$f_{threshold}=\mu E/4p$$

where μ, E, and p are electrophoretic mobility of the species, E field, and pitch, respectively. The frequency response curve is shown in FIG. 2 for two samples with similar molecular weights (MW). The synchronous range is characterized by rapid transport with a linear increase in transport velocity and minimal dispersion. This is the regime for fast initial separation. The asynchronous regime is characterized by slower transport velocity and large velocity dispersion. This is the regime for increased separation between samples of similar molecular weights. Increasingly optimal transport conditions cause the synchronous part of the curve to be steeper and attain a higher peak.

The exemplary embodiment sample manipulator takes advantage of the different regimes of transport behavior to provide several strategies to manipulate samples and to control experiments with visual feedback. The key is the ability to select individual electrodes, or groups of electrodes, and to invoke the specific traveling wave algorithm to be applied to them to achieve the desired functions.

Approximately 6 cm of track is available on a conventional one inch by three inch footprint microscope slide. The implementation of four phase drives on the traces may be accomplished either through group addressing, e.g. addressing four traces at once, or with individual addressing.

Group addressing with 4 phases reduces the number of connections to 62/cm, but would require division of the 6 cm track into 6 groups of individually addressable 1 cm contiguous segments to achieve the different modes of operation to be described. Resolution or a measure of the width of the narrowest focused sample would be determined by the group pitch or 160 um. Individual addressing with 4 phases would require all 1500 connections to be made, but would not require physical division into segments. Resolution is now improved to a single trace pitch, or 40 um.

Although a wide array of configurations, arrangements, and dimensions may be used for the electrodes or other components of the sample manipulators described herein, several exemplary aspects are as follows. The electrode pitch can be in the range of from about 600 μm to about 10 μm, and generally from about 200 μm to about 20 μm. The spacing between opposing edges of adjacent electrodes can be from about 300 μm to about 7.5 μm and generally from about 100 μm to about 10 μm. Modeling and fabrication capability has suggested a design configuration for trace width of 10 um on 40 um pitch resulting in 250 traces/cm of track. The distance between centers of adjacent traces is referred to as "pitch." The preferred voltage level applied to the grid and electrodes is from about 5 V to about 0.001 V and more preferably about 2 V to about 0.10 V. The transport mechanism depends on sustaining electrochemistry at electrode locations, but at a controlled level below that for significant gas formation. In the absence of electrochemistry, mobile ions in the medium form Debye double layers that effectively suppresses the electrostatic field needed in the medium to allow transport. Further control of conductivity is achievable through the use of zwifterions, as known to those skilled in the art. The preferred frequency of the electrical signal depends upon the sample, biomolecules or charged species to be transported, however frequencies in the range of from about 0.001 to about 25 Hz have been found useful, with particular frequencies being from about 0.020 to about 2 Hz.

As previously noted, the exemplary embodiment sample manipulator provides that a sample deposited on the sample manipulator, can be interactively steered by a user. That is, by application of appropriate voltage waveforms to the traveling wave electrodes, the sample can be selectively directed along the face or viewing surface of the sample manipulator. Application of one or more different waveforms to one or more different regions of the traveling wave grid(s) on the sample manipulator may be performed by using commercially available actuators or controllers. An example of such a controller is a joy-stick control known to those skilled in the art. Furthermore, it is contemplated that appropriate software can be used to enable one or more different waveforms to be applied, or changed during a transport or sample manipulation. For example, if upon application of a first waveform, a user wishes to change one or more parameters such as sweep frequency or voltage levels, control software can be used to readily implement the desired modifications. This ability to readily change and implement the changes during a sample manipulation is referred to herein as "on-the-fly."

The exemplary embodiment contemplates at least three modes of operation, but in no way is the exemplary embodiment limited to such. It is envisioned that additional modes of operation could be utilized. These modes, described in detail below, can be used in conjunction with SDS-PAGE or various aspects thereof. Before describing these modes of operation, it is instructive to review SDS-PAGE technology.

SDS-PAGE is an analytical method using principles of electrophoresis to separate molecules, usually biological proteins. Electrophoresis involves the migration of charged molecules in a solution in response to an electric field. Their rate of migration depends on the charge, size, and weight of the molecule. As an analytical tool, it is simple, rapid, and highly sensitive.

Sodium dodecyl sulfate (SDS), also known as lauryl sulfate, is an ionic detergent which denatures proteins. When applied to a mixture of proteins, it binds to their polypeptide backbone through hydrophobic interactions, disrupts hydrogen bonds, blocks hydrophobic interactions, and partially unfolds them, minimizing differences in molecular form by eliminating the tertiary and secondary structures. A reducing agent such as 2-mercaptoethanol or dithiothreitol is usually used to cleave disulfide bonds as well. SDS masks the native charge of each protein, resulting in a complex that is fairly linear and has a constant net negative charge per unit mass. When treated in this way, the effect of the charge and size of each protein is minimized and separation is possible based solely on the molecular weight of the protein.

PAGE stands for PolyAcrylamide Gel Electrophoresis. This gel is synthesized by the combination of acrylamide monomer, a cross-linking co-monomer such as bisacrylamide, a buffer, and an initiator such as ammonium persulfate and accelerator such as tetramethylenediamine (TEMED) that drive the polymerization reaction. The result is a matrix of fibers that create pores of various sizes. Pore size can be controlled by varying the percentage of monomers in the gel and the ratio of monomer to cross-linking co-monomer.

SDS-PAGE equipment is commercially available from sources such as Bio-Rad and Amersham (now part of GE Healthcare). It usually consists of two buffer reservoirs, one for the anode and one for the cathode. A direct current power supply connects two electrodes which are immersed in the buffer reservoirs. The polyacrylamide gel, connects the buffer reservoirs. Sample wells are typically in one end of the gel and the sample proteins are placed in the wells. Other equipment, such as a cooling block, can be used as well.

When an electrical field is applied, the SDS-treated proteins migrate through the pores across the gel. Smaller proteins travel through the pores more quickly than larger molecules. The rate of migration is inversely linear with the logarithm of the molecular weight. When combined with standards of known molecular weight, the protein's molecular weight and size can be determined. Other techniques, such as two-dimensional gel electrophoresis, can also be used in combination with SDS-PAGE for greater resolution of samples.

For more information on SDS-PAGE, see Electroseparations (Electrophoresis), *Kirk-Othmer Encyclopedia of Chemical Technology,* $4^{th}$ ed., vol. 9 (Wiley-Interscience, 1994); Andrews, A. T., *Electrophoresis:Theory, Techniques, and Biochemical and Clinical Applications,* $2^{nd}$ ed. (Clarendon Press: 1993); and Robyt, John F. et al, *Biochemical Techniques: Theory and Practice,* $2^{nd}$ ed. (Waveland Press: 1987), all of which are herein incorporated by reference.

Figure 3:
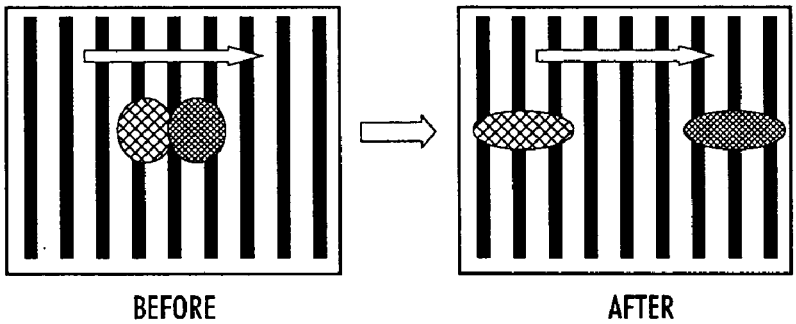
FIG. 3 illustrates dispersive mode separation of two sample spots.

A first mode of operation of the exemplary embodiment sample manipulator is designated herein as a "dispersion mode." In a general sense, this method provides a technique for separating two or more samples or types of molecules, species, or populations, having a similar molecular weight (or mass), by using electrostatic traveling waves. FIG. 3 illustrates a mixture of at least two samples with similar molecular weight (MW) that is introduced at one end of the traveling wave grid. Knowing the MW, the electrophoretic mobility may be used to determine a sweep frequency so that the mixture runs in the asynchronous mode just beyond the threshold frequency shown in FIG. 2. In SDS-PAGE, proteins develop a charge proportional to their MW. Mobility is inferred from the migration distance of standard proteins with well-defined MW. The relatively large Δv (velocity difference) results in the two samples being separated or dispersed over a length of travel on the 6 cm track. Preliminary calculations for SDS-PAGE show that two proteins 200 Daltons apart, centered at 15 kDa, can exhibit a 41% increase in spatial separation with a 3.4× decrease in separation time compared to conventional gel electrophoresis.

Since a MW of 80 Daltons represents the minimum difference for detection of post-translationally modified proteins, this capability can be an important separation tool.

Specifically, an exemplary process for separating samples according to this mode is as follows. A sample containing at least two types of molecules, charged species, or other populations, is deposited or otherwise introduced at a first region of the exemplary embodiment sample manipulator. Alternately, samples could be deposited onto the exemplary embodiment manipulator sequentially, such as in different applications. The user, knowing or hypothesizing the average or median MW of each molecule or species to be analyzed, determines a suitable sweep frequency so that the sample, i.e. collection of molecules or species, is displaced in an asynchronous manner just beyond the threshold frequency. A multi-phase voltage waveform is applied to the busses, and thus traveling wave grid, of the sample manipulator, at the determined sweep frequency. Differences in displacement rates by the molecules or species under review across the traveling wave grid will become apparent, and spatial separations will occur between different regions of the molecules or species.

Figure 4:
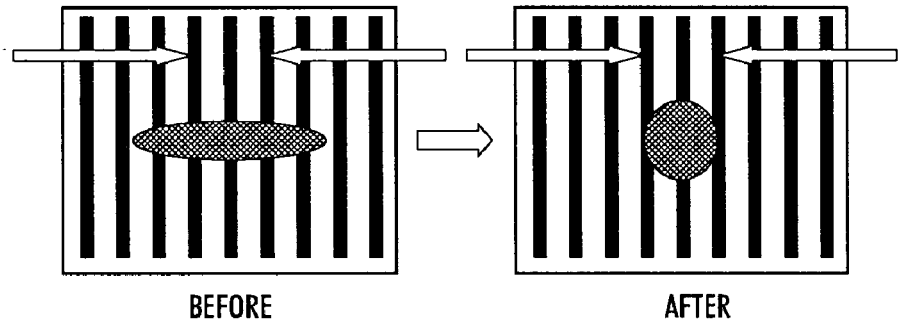
FIG. 4 illustrates concentration mode focusing of a sample spot.

A second mode of operation is designated herein as a "concentration mode." In this mode, the exemplary embodiment sample manipulator may be used to focus samples in a particular mass range. This is accomplished by selecting a specific location on the electrode grid and generating opposing traveling waves to move proteins to that location as shown in FIG. 4. This mode is particularly important when a sample is in such dilute quantities that its concentration may increase to the limit of detection (LOD). The limit to band compactness would be backdiffusion to counter drift. A simple estimate is given by $E(w/2)=kT/q$, where E, w, k, T, q are respectively, E field, width of the protein band, Boltzmann constant, temperature, and charge. By increasing the local E field by an order of magnitude, the band may be compacted by up to 10×. As stated earlier, for certain embodiments the width of the narrowest band would be 40 um for individual electrode addressing and 160 um for group addressing.

An exemplary process for this mode of operation is as follows. A sample to be concentrated is deposited or otherwise introduced onto the exemplary embodiment sample manipulator. Generally, the region at which the sample is deposited is between two source locations from which traveling waves may originate. For example, if a first voltage waveform can be applied to a first end of the exemplary embodiment sample manipulator to thereby generate a first set of traveling waves from that end, and if a second voltage waveform can be applied to a second end of the exemplary embodiment sample manipulator to thereby generate a second set of traveling waves from the second end; then the sample to be concentrated is deposited between these ends and ideally, generally at equal distances from each end. The two waveforms are applied, one at each end, either sequentially or concurrently, which thereby generate two sets of electrostatic traveling waves. Concentration can occur with only one set or source of traveling waves. And, concentration can occur by generating traveling waves at only one location, or from a multitude of locations on the traveling wave grid. It will be appreciated that concentrating or rather "compacting" of the sample will occur in a direction that corresponds to the direction of travel of the traveling waves, and thus in a direction generally perpendicular to the traveling wave electrodes or traces. Restated, the sample is essentially concentrated by undergoing a contraction in the area which the sample occupies on the sample manipulator. That is, the sample or rather particular molecules or charged species contained within the sample, are effectively urged together to a higher density or concentration. The increase in density is with regard to the amount or quantity of molecules or species per unit surface area on the sample manipulator.

A third mode of operation is designated herein as a "reaction mode." In this mode, the exemplary embodiment sample manipulator may be used to move one or more species into contact with a target sample, the purpose being to have the species undergo a reaction with the target sample, or to test if any reaction or interaction occurs. The relative motion can be accomplished in a number of ways. For example, the species to be brought into contact with the target sample can be placed on one end of the sample manipulator, and the target sample can be placed in a separate location on the manipulator. Then a traveling wave of the appropriate frequency can be used to move the said species into contact with the target sample, while at the same time an opposing electrostatic force can be applied using traveling wave electrodes downstream of the target sample to prevent it from moving. After a specified amount of time in contact, the user can switch to dispersion mode, if it is desired to control the amount of time of a reaction. Alternatively, one can use the concentration mode to hold the target sample in place, which will also move the upstream species to the target sample.

Figure 5:
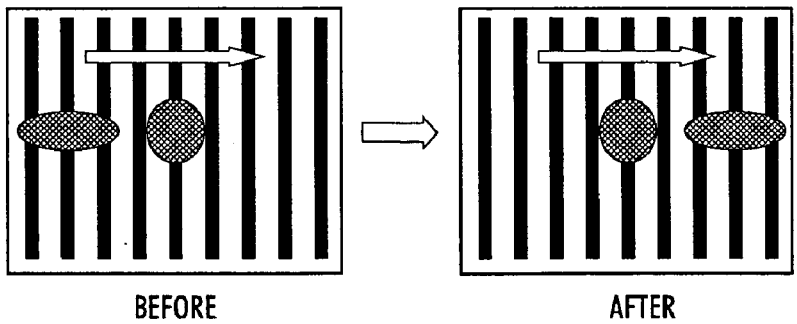
FIG. 5 illustrates reaction mode mixing of a sample with a reagent to detect binding.

Target samples of interest include various biological complexes, examples being protein complexes, nucleic acid complexes, protein-nucleic acid complexes, organelles, ribosomes, multienzyme complexes (a type of protein complex), and viruses. These are relatively large entities that can have well defined native charge and size in the appropriate buffer. Thus, they can be moved, concentrated, and held in place by traveling waves in the same manner as simpler proteins. However, they can also have mobilities significantly different from individual molecules such as proteins, peptides, small molecule drugs or drug leads, making the threshold frequency threshold significantly different from that of the individual molecules. This makes it possible to separate, concentrate, and otherwise manipulate such systems. For example, one application of the present exemplary embodiment involves isolating a much heavier protein complex by moving all other lighter proteins out of a mixture. The remaining complex can then be reacted by moving reagents of interest through the location of the complex on the sample manipulator at the desired rates. Binding energies and so forth may also be determined by separating the complex and reagent using traveling waves. Many potentially useful manipulations, including, but not limited to, mixing, separating, and detection of bound states, can be performed. In this example of the use of traveling waves in reaction assay as a manipulator, the reagent is moved through a stationary protein complex as shown in FIG. 5. The reagent is initially deposited upstream of the protein to be analyzed. The protein complex may be immobilized or slowed down by tuning a sweep frequency for asynchronous (slower) transport while the reagent is tuned for synchronous (faster) transport. The resulting percentage of reagent emerging from the protein complex may provide useful information on binding energy/strength between the two reacting entities.

Specifically, a representative process corresponding to this mode of operation is as follows. A first sample containing molecules or species to be analyzed by a reaction, are deposited at one end of the exemplary embodiment sample manipulator. At a location upstream of the first sample, a second sample containing a suitable reagent is deposited.

One or more voltage waveforms are applied to the manipulator to thereby cause the reagent to pass through the first sample.

Examples of complexes that have mobilities different from individual molecules that can bind to the complex are well known in the literature, demonstrating the feasibility of this mode of operation. In fact, widely-used electrophoretic mobility shift assays rely on this behavior. The exemplary embodiment described herein provides a more interactive control of the relative velocity and location of reagents with different electrophoretic mobilities, as well as a richer set of possible manipulations both in space and time, providing capability that traditional electrophoretic mobility shift assays can not provide.

Two complexes of interest are ribosomes and vesicles. Hawker, et al., Biotechnol. Prog. 1992, 8:429–435, herein incorporated by reference, report that the electrophoretic mobility of ribosomes in a medium of viscosity 1.59 cP is −6.8×10−5 cm2/(V sec), and that of vesicles formed from membrane fragments upon lysing a cell were measured to be −4×10−5 cm2/(V sec) and −0.9×10−5 cm2/(V sec) for two vesicle populations. Vesicles from cell membranes can be important in reaction systems because they will contain membrane proteins and can therefore be used to test reactions and binding with such membrane proteins. Ribosomes are of interest because they are sites for protein synthesis.

Operation can be either in free solution or in gels. Mobilities in gels, such as polyacrylamide gels, will be much lower for both multimolecular complexes and individual molecules, making separation in gels still practical. In fact, if the effective pore size in a gel is intermediate between the size of a typical protein (1–10 nm) and a ribosome (diameter=25 nm) or vesicle (diameter=250 nm in the study by Hawker, et al.), then the difference in mobility will be increased due to steric hindrance of complex motion, making the exemplary embodiment sample manipulator even more practical for probing the interactions discussed here. For the noted mobility of a ribosome, if one uses the simplified expression $\mu=q/(6pvR)$, q being charge, v being viscosity, and R being radius, then the calculated net charge is 16e; also, the molecular weight of a ribosome is 25 MDa. These numbers illustrate why the sample manipulator device can be used as described herein to move individual proteins, e.g. with molecular weights of 10 kDa to 250 kDa and net charges of as few as a few e, relative to complexes. Examples of complexes include protein complexes, protein-nucleic acid complexes, ribosomes, protein-lipid complexes like membrane fragments, endoplasmi reticulum fragments, Golgi apparatus samples, viruses, multienzyme complexes, and combinations thereof.

Another reaction mode can be based on having immobilized target entities at the focal point of a microscope, and moving test agents on request to the target area using the traveling wave grid. Possible methods include anti-body affinity measurements and measurement of responses of immobilized cells, bacteria or viruses to environmental changes. In anti-body affinity measurements, either the antibodies are tethered to the surface or selected agents are moved across them. This could be used, e.g. in a diagnostic mode to see whether a particular sample reacts with the antibody. One could also fix the antigen proteins to the surface and test different anti-bodies whether they bind specifically to the target. Another example of a reaction mode method involves the measurement of responses of (immobilized) eukaryotic cells, bacteria or viruses to changes in the environment caused by the presence of selected bio-agents (proteins, toxins, etc) that are transported to the target area using the traveling wave grid. In both cases, a change in the target molecule under the influence of the test agents can be seen using a multi-spectral imaging technique.

ELISA usually involves a reaction step where mobile tagged molecules react with immobilized biomolecules and a washing step to remove unbound molecules. The specifically bound molecules that remain on the target are visualized (e.g. by fluorescence). One possible form of ELISA is a "sandwich assay" which requires two types of mobile molecules (usually a capture antibody and a target antigen) that only together bind to the (immobilized) probing antibody and generate fluorescence or other forms of light output. A typical application is using the TW force to expedite the reaction process and enhance the signal intensity of applications such as a Handheld Assay "ticket".

In many cases where the slides will not be washed subsequent to the manipulation, a type of detection scheme called fluorescent resonance energy transfer (FRET) may be applied. In FRET, the probing biomolecule and the target molecules are labeled with two different dyes. Light emitted from one of them (shorter wavelength) can excite (and thus transfer the energy) to the other. This results in the second dye emitting a longer wavelength light only when the probing molecule is in close vicinity (e.g. several nm) to interact with the target molecules. Traveling wave on these smart slides can be applied to move different probing molecules sequentially first into the vicinity of the immobilized target and then away from the target, if they do not interact. Those that remain bound are genuine interaction partners and will respond to excitation and generate FRET effects.

Figure 6:
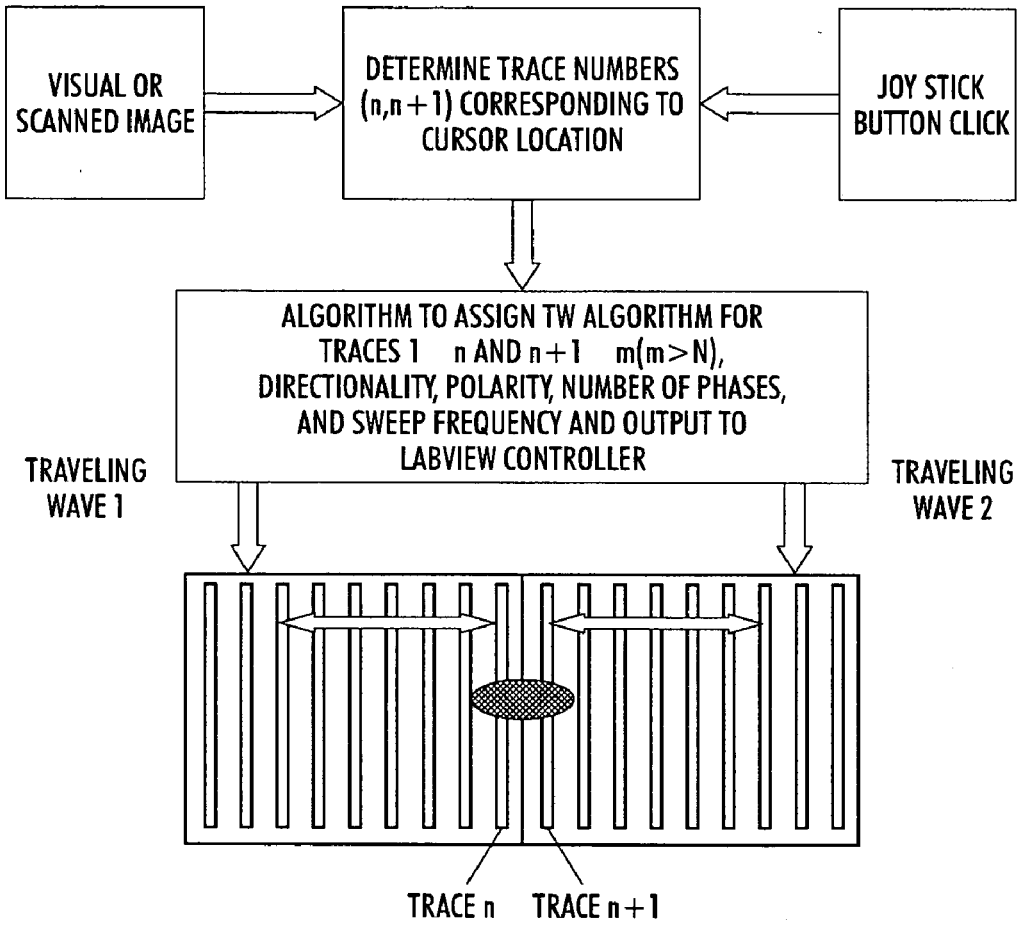
FIG. 6 is a schematic flow chart of interactive flow control of the exemplary embodiment sample manipulator with near real-time visual feedback and joy-stick control.

In another aspect of the exemplary embodiment, a system is provided comprising the sample manipulator in conjunction with an interactively steerable control. In this aspect, the user has control over the experiment from visual cues provided by the near real-time visualization system, which may be UV fluorescence or staining, for example. Control is provided by two steps: placing the cursor of the joy-stick in the space between two traces, and issuing a thumb click. An image is generated which may include registration cues and allows an algorithm to identify the two adjacent traces as n and n+1. Depending on the mode of use, preprogrammed traveling wave algorithms with a technique or ability of selecting the sweep frequencies may be exercised through a Labview controller to the traveling wave grids. This sequence of interactive control is illustrated in FIG. 6. The system can also comprise multiple sample manipulators that are in electrical or signal communication with the controller. In this regard, the collection of sample manipulators could, in certain applications, be tiled or otherwise arranged.

The exemplary embodiment utilizing a plurality of busses and inter-connection ability enables multiple sample manipulators to be used collectively or "tiled" such that a sample can be selectively moved or displaced from one sample manipulator to another located or positioned adjacent thereto. Specifically, the unique configuration of the exemplary embodiment sample manipulators described herein enables displacement of one or more samples on a first sample manipulator to one or more adjacent sample manipulators. The systems of the exemplary embodiment include multiple sample manipulators that are disposed alongside each other; disposed along two, three, or more sides of a first sample manipulator; and arranged in non-linear arrays. Generally, when configured in such tiled arrangements, each of the sample manipulators are in electrical communication with one or more controllers such that they can receive control signal(s) or appropriate waveforms.

The sample manipulators are also in electrical communication with each other generally through their busses.

Although a Labview controller is noted, the exemplary embodiment can be used in conjunction with nearly any computer-based controller. Generally, such a controller will be in the form of an electronic controller that utilizes waveform software and a digital/analog (D/A) hardware card to interface between the exemplary embodiment device and the controller.

Figure 7:
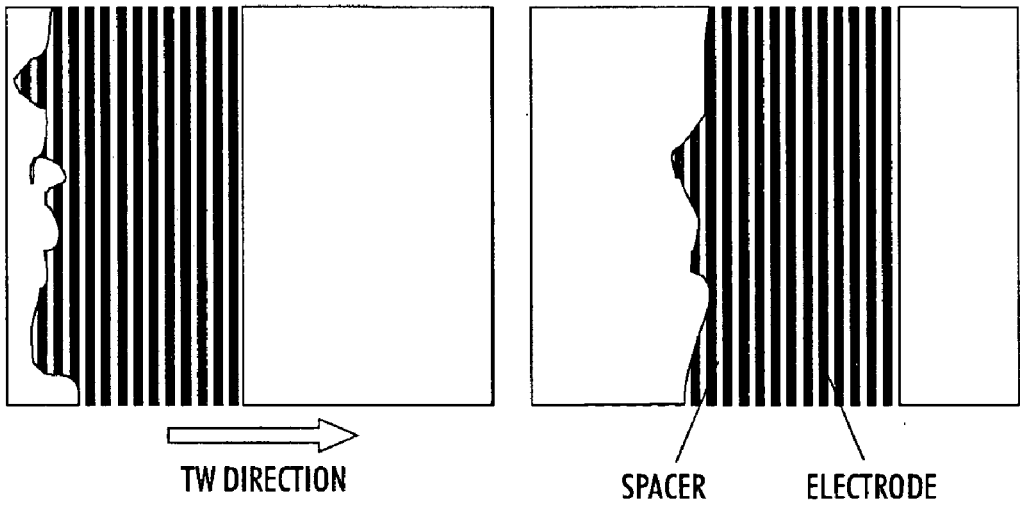
FIG. 7 depicts before and after illustrations of protein motion on a traveling wave grid.

The exemplary embodiment sample manipulator and its operation has been demonstrated for protein transport on SDS-PAGE gels, through modeling of traveling wave transport, through design and fabrication of a 3-layer vertically integrated cell (VIC), and through a conceptual design of the driver electronics. Traveling wave transport of fluorescent-tagged proteins was shown on a grid with an electrode spacing of 30.5 μm and electrode width of 19 μm. A custom cast 100 um gel was loaded with a 25 kDa protein, then laid on top an electrode array and excited with a 1V traveling wave. PAGE or agarose gel can be prefabricated and pre-cast gels are also available from various sources (e.g. Bio-Rad, Amersham or GE Heathcare, BD Biosciences, etc). If needed, DNA or protein complex mixtures can be pre-loaded onto the gel with traditional gel electrophoresis assembly and the precise area containing the desired samples excised and placed on the TW grids on the smart slide. FIG. 7 shows before (left) and after (right) illustrations of the fluorescent protein band, providing evidence of protein motion in the gel. In this figure, proteins have been moved to the right and partially compacted. Simulation has predicted the modes of transport. The design of the 3-layer exemplary embodiment sample manipulator geometry is an extension of the VIC which has a 1 cm×1 cm footprint and was designed for geometric scaling to wider dimensions by tiling.

Figure 8:
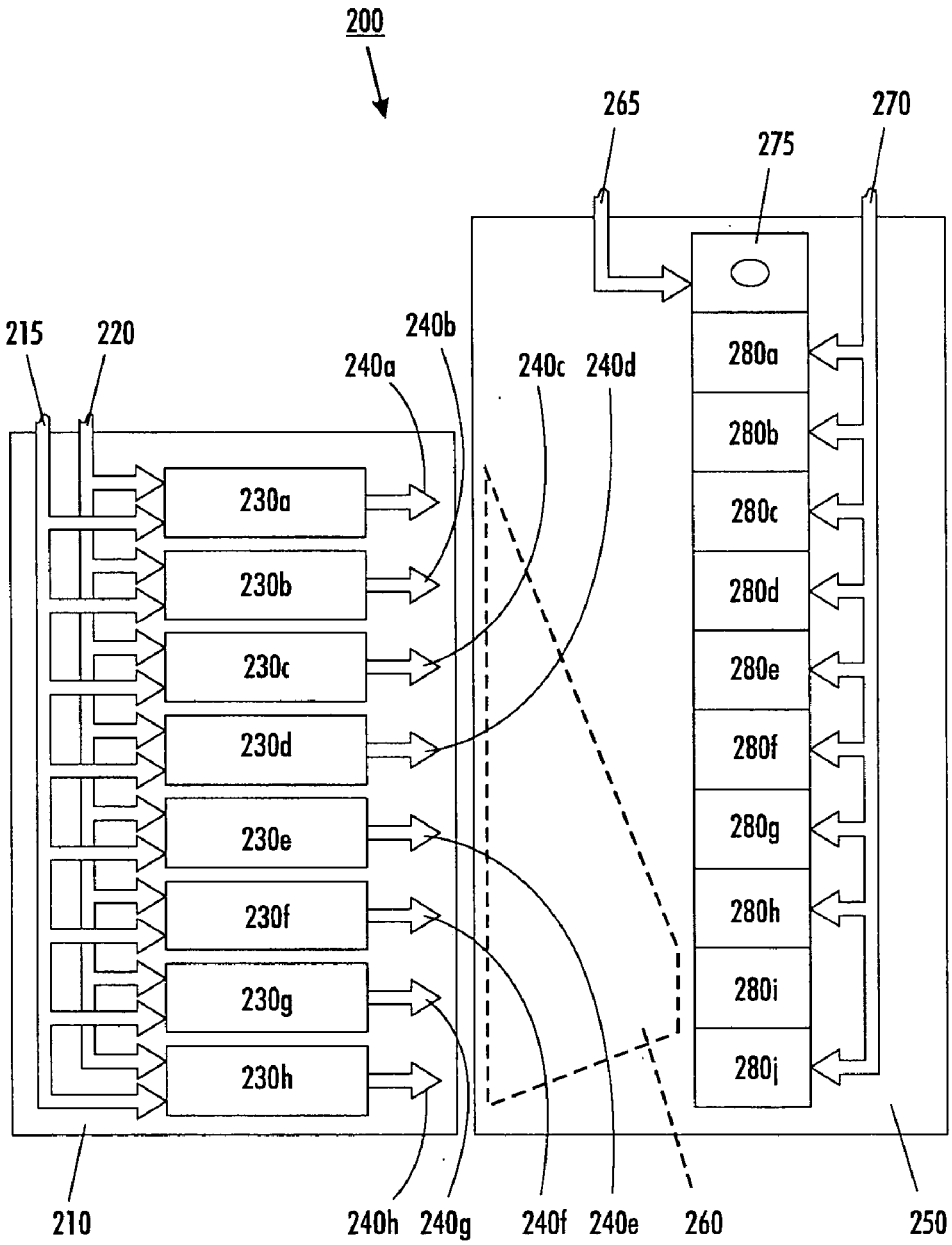
FIG. 8 is a schematic illustration of an electronic controller for individually addressable electrodes.

FIG. 8 illustrates a schematic of the electronics for a 10 cm track that includes 10 1 cm segments. Only 1 of the segments has individually addressable electrodes while the remaining 9 are group addressable. Specifically, FIG. 8 illustrates an exemplary embodiment system utilizing an exemplary embodiment sample manipulator as described herein. Specifically, the system 200 comprises a controller 210 and a sample manipulator 250. The controller is preferably in the form of a printed circuit board and produces two hundred and fifty signals to drive individually addressed electrodes on the sample manipulator 250. The controller 210 includes a plurality of busses 215 for analog voltages $V_{high}$ and $V_{low}$. The controller 210 also includes a plurality of inputs 220 for addressing and control of chip or other microprocessors or control elements on the circuit board of the controller 210. The controller 210 also includes one or more control chips 230 shown in FIG. 8 as 230*a*–230*h*. The controller 210 also provides for a plurality of control outputs 240*a*–240*h*. The controller 210 receives information from the inputs 220 such as the selection and activation of the appropriate chips 230 on the controller 210. After appropriate processing, the controller 210 provides control signals through control outputs 240*a*–240*h* to an interface connection 260 of the sample manipulator 250.

The sample manipulator 250 generally corresponds to the previously described sample manipulator 100 shown in FIG. 1. In the particular embodiment shown in FIG. 8, the manipulator 250 utilizes a glass substrate having an active area of approximately 1 cm by 10 cm active area. The manipulator 250 includes 2500 electrodes total which include 2250 driven by a four phase driver signal and 250 individually addressable electrodes. The sample manipulator 250 includes inputs 265 for sample loading control. The sample manipulator 250 also includes inputs 270 for the four phase control signal. The sample manipulator 250 additionally includes a sample loading area 275 and one or more traveling wave grids 280 designated as 280*a*–280*h* in the referenced figure. Each traveling grid such as 280*a*, includes 250 electrodes and spans a region of 1 cm by 1 cm.

The exemplary embodiment sample manipulator can be in a wide range of sizes. For example, as noted, the sample manipulator can be square with dimensions of 1 cm by 1 cm. Alternately, the sample manipulator can be rectangular with a footprint corresponding to conventional microscope slides, such as for instance 1 inch by 3 inches, or 500 mm by 750 mm. However, it will be understood that the exemplary embodiment sample manipulator is in no way limited to these specific shapes or dimensions.

The exemplary embodiment can be utilized in conjunction with a wide array of particles or species. For transport in air or other gaseous media, particles having diameters (or spans if non-spherical) of up to about 40 or 50 μm can be effectively displaced. For transport in water or other similar liquid media, particles having diameters or spans of from several nanometers to about 10 μm can be effectively transported. For media such as gels, the following are noted. Proteins having dimensions of several nanometers to about 100 nm can typically be displaced in a polyacrylamide gel. And, when residing in an agarose gel, DNA having dimensions of up to 1 μm can typically be displaced. Although not wishing to be limited to any particular particle characteristics, particles having a density of from about 0.05 g/cm$^3$ to about 0.5 g/cm$^3$, with 0.1 g/cm$^3$ being typical, are well suited for transporting in air or other gaseous medium. Similarly, it is believed that particles having a charge of from several femto coulombs (fc) in air to about 0.01 fc in liquids can be effectively transported. For particles not having any native charge, pH adjustment of an aqueous medium or a charged reagent such as SDS can often be used to impart charges on certain biomolecules to enable transport.

The advantages of the exemplary embodiment sample manipulator include, but are not limited to the following. The sample manipulator is pro-active as compared to a passive slide. The sample manipulator enables the use of interactive steering. The sample manipulator may be precisely controlled thereby facilitating dispersion, concentration, and reaction experiments. The sample manipulator can be used in a wide array of different applications.

Variations or modifications of the exemplary embodiment sample manipulator can be utilized in a wide array of systems and applications. For example, the exemplary manipulator can include one or more microfluidic channels. Such a variant embodiment could provide for "lab-on-a-chip" processing capabilities. In addition and related to this, sensitive detection devices or components could be incorporated within or in conjunction with the sample manipulator to provide integrated detection capabilities for biochemical agents.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

What is claimed is:

1. A method for reacting a suitable sample and reagent pair by use of a sample manipulator comprising (i) a substrate, and (ii) a plurality of traveling wave electrodes disposed on the substrate, the method comprising:

depositing the sample at a first location on the sample manipulator;

depositing the reagent at a second location on the sample manipulator;

determining a suitable frequency for a voltage waveform to be applied to the electrodes of the sample manipulator; and applying the voltage waveform at the determined frequency to the sample manipulator to thereby cause electrostatic traveling waves to move at least one of the sample and the reagent into contact with the other and thereby enable reaction therebetween.

2. The method of claim 1 wherein the sample is tagged with a fluorochrome immobilized on the substrate, and the reagent is tagged with a second fluorochrome that is able to generate fluorescence resonance energy transfer (FRET) effects.

3. The method of claim 2 wherein the reagent is moved to close proximity and then moved away from the sample by traveling waves on the sample manipulator to determine whether fluorescence resonance energy transfer (FRET) effect has occurred between the two.

4. The method of claim 1 wherein two different types of molecules are moved simultaneously by traveling waves to close proximity of a third immobilized molecule whereas all three are required to interact and produce signals.

* * * * *